US005530615A

United States Patent [19]

Miller et al.

[11] Patent Number: 5,530,615

[45] Date of Patent: Jun. 25, 1996

[54] METHOD AND APPARATUS FOR ENHANCING RELAY LIFE

[75] Inventors: Mark E. Miller, Versailles; Mark A. Eifler, Frankfort; Alan R. Sawyers, Lexington; Mitchell R. Rowlette, Berea, all of Ky.; Craig M. Nold, Murfreesboro, Tenn.

[73] Assignee: Texas Instruments Incorporated, Dallas, Tex.

[21] Appl. No.: 163,782

[22] Filed: Dec. 6, 1993

Related U.S. Application Data

[63] Continuation-in-part of Ser. No. 886,274, May 20, 1992, abandoned.

[51] Int. Cl.[6] ..... H02H 3/033

[52] U.S. Cl. ..... 361/160; 361/171; 361/195; 361/3; 307/141

[58] Field of Search ..... 361/160, 3, 171, 361/195; 307/139, 141, 141.4

[56] References Cited

U.S. PATENT DOCUMENTS

| | | | |
|---|---|---|---|
| 4,352,349 | 10/1982 | Yoho | 126/299 R |
| 4,648,551 | 3/1987 | Thompson et al. | 165/40 |
| 4,659,290 | 4/1987 | Kundert | 236/DIG. 9 |
| 4,686,598 | 8/1987 | Herr | 361/31 |
| 4,688,547 | 8/1987 | Ballard et al. | 126/110 R |
| 4,722,669 | 2/1988 | Kundert | 525/484 |
| 4,745,515 | 5/1988 | Fowler | 361/185 |
| 4,789,330 | 12/1988 | Ballard et al. | 431/75 |
| 4,860,231 | 8/1989 | Ballard et al. | 364/571.01 |
| 4,863,372 | 9/1989 | Berlincourt | 431/66 |
| 4,901,918 | 2/1990 | Grald et al. | 364/143 |
| 4,922,363 | 5/1990 | Long et al. | 361/3 |
| 4,934,925 | 6/1990 | Berlincourt | 431/71 |
| 4,935,606 | 6/1990 | Geary | 307/43 |
| 4,935,607 | 6/1990 | Kadwell et al. | 364/184 |
| 4,978,896 | 12/1990 | Shah | 236/DIG. 9 |

FOREIGN PATENT DOCUMENTS

| | | |
|---|---|---|
| A-0108538 | 5/1984 | European Pat. Off. . |
| A-0353986 | 2/1990 | European Pat. Off. . |
| A-0429159 | 5/1991 | European Pat. Off. . |
| A-2488036 | 2/1982 | France . |

*Primary Examiner*—William M. Shoop, Jr.
*Assistant Examiner*—Peter Ganjoo
*Attorney, Agent, or Firm*—Russell E. Baumann; Richard L. Donaldson; René E. Grossman

[57] ABSTRACT

An electronic control for gas furnaces controls a two speed main blower fan and an induction draft fan based on 24 volt input signals from a room thermostat, a high limit and an ignition control including a gas valve. The input signals are coupled to input ports of a microprocessor through current limiting resistors and to AC ground through pull down resistors. AC ground is also connected to the IRQ port of the microprocessor. Output ports of the microprocessor are connected to a relay driver which in turn is connected to relays for energizing and de-energizing the fans. The control calibrates itself on a continuing periodic basis to read the AC inputs synchronously at the peak of their wave and can switch the relays asynchronously based on the Real Time Clock of the microprocessor or can be switched synchronously by providing a selected delay so that contact engagement and disengagement occurs at or near the zero crossing of the AC line voltage wave form. When used with resistive loads the relays are switch in response to a signal from the microprocessor which is delayed based on the mechanical switching time constant of the relays to provide contact closure and opening at the selected point on the AC line voltage wave form. An alternate embodiment shows a feedback network used to calibrate the specific delay period for each relay upon initialization. When used with inductive loads contact closing can be effected synchronously and contact opening asynchronously.

18 Claims, 22 Drawing Sheets

PART 1

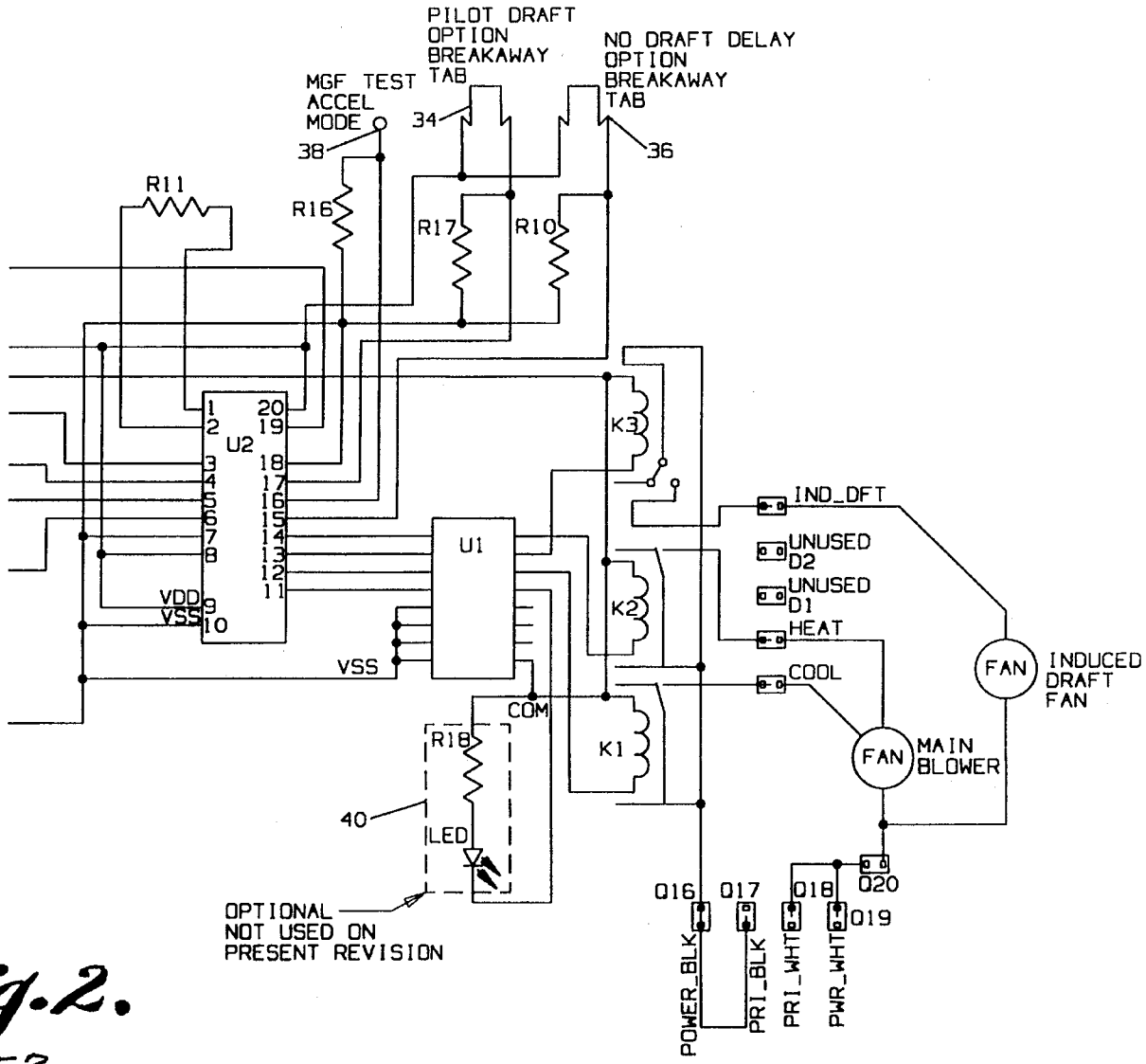
Fig. 2. PART 2

INPUT CALIBRATION ROUTINE

PROGRAM OVERVIEW

COUNTER ROUTINE

INDUCED DRAFT OUTPUT ROUTINE

MEMORY MAP

COUNTERS

GOFFCTR
IDOFFCTR
MVOFFCTR
MVOFFCTR

FLAGS

GFLAG1, GFLAG2
WFLAG1, WFLAG2
MVONFLAG
MVOFFLAG1, MVOFFLAG2

248

| | 7 | 6 | 5 | 4 | 3 | 2 | 1 | 0 |
|---|---|---|---|---|---|---|---|---|
| FLAGREG1 | RFLAG | GFLAG1 | GFLAG2 | WFLAG1 | WFLAG2 | MVOFFLAG1 | MVOFFLAG2 | MVONFLAG |

250

| | PB 7 | 6 | 5 | 4 | 3 | 2 | 1 | 0 |
|---|---|---|---|---|---|---|---|---|
| INPUTS | | | G/EON | R/LIMIT | W1 | MV | | W2 |

252

| | 7 | 6 | 5 | 4 | 3 | 2 | 1 | 0 |
|---|---|---|---|---|---|---|---|---|
| FLAGREG2 | COOL | HEAT | IND DFT | | CL_HTFLAG | HT_CLFLAG | TIMEOUT2 | TIMEOUT1 |
| | PA2 | PA1 | PA0 | | | | | |

254

| | | | | | | 2 | 1 | 0 |
|---|---|---|---|---|---|---|---|---|
| OUTPUTS | | | | | | COOL | HEAT | IND DFT |

Fig. 14.

HEAT TRUTH TABLE

| INPUTS | | | | OUTPUT |
|---|---|---|---|---|
| RFLAG | MVONFLAG | MVOFFLAG1 | MVOFFLAG2 | HEAT |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 0 |
| 1 | 1 | 0 | 1 | 1 |
| 1 | 1 | 1 | 0 | 1 |
| 1 | 1 | 1 | 1 | 1 |

Fig. 15.

COOL TRUTH TABLE

| INPUTS | | OUTPUT |
|---|---|---|
| G/ECON | GDLYOFF | COOL |
| 0 | 0 | 0 |
| 0 | 1 | 1 |
| 1 | 0 | 1 |
| 1 | 1 | 1 |

Fig. 16.

INDUCED DRAFT TRUTH TABLE

| INPUTS | | | | OUTPUT |
|---|---|---|---|---|
| RFLAG | MVONFLAG | WFLAG1 | WFLAG2 | IND DFT ON |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 1 |
| 1 | 1 | 0 | 1 | 1 |
| 1 | 1 | 1 | 0 | 1 |
| 1 | 1 | 1 | 1 | 1 |

Fig. 17.

PART 1

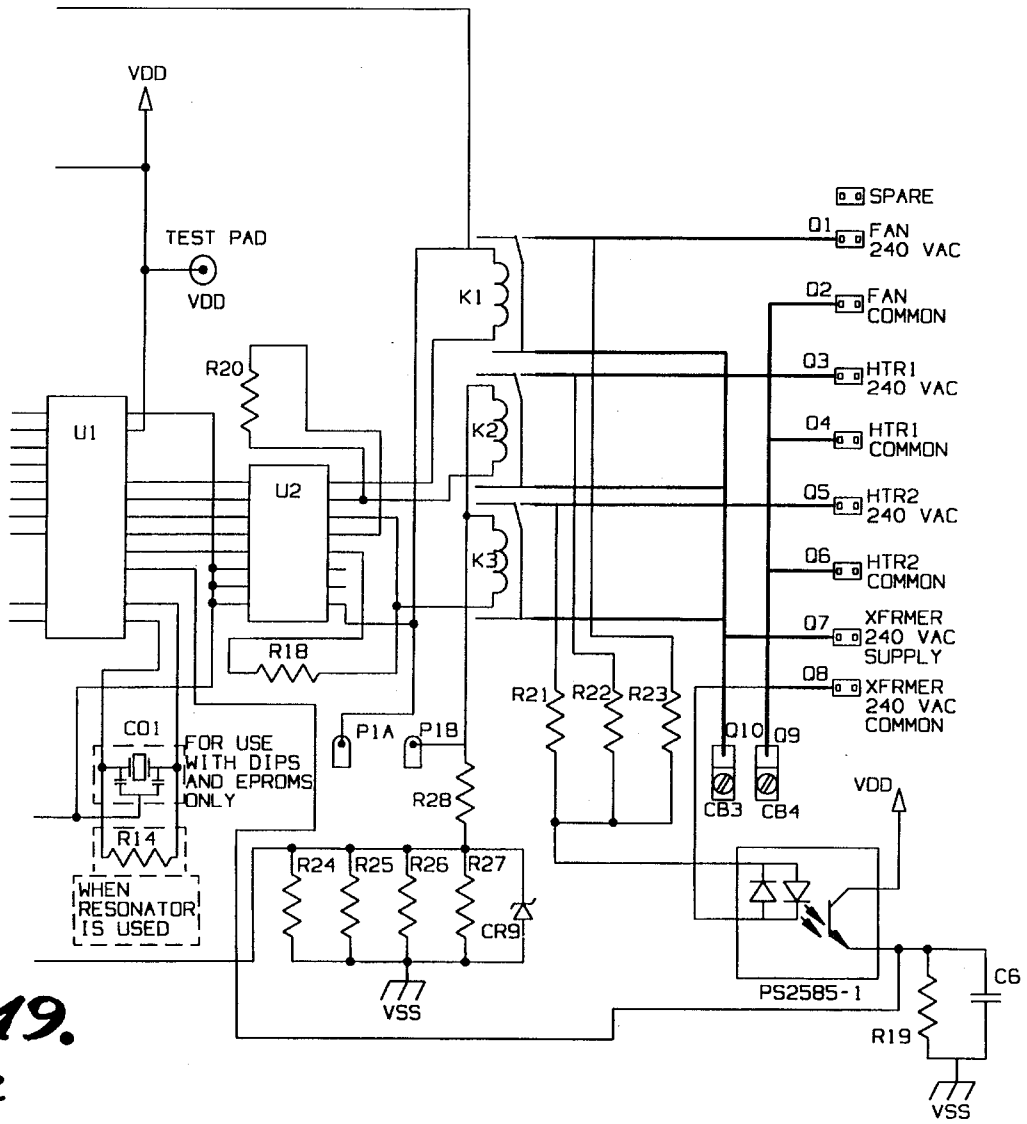
Fig. 19. PART 2

METHOD AND APPARATUS FOR ENHANCING RELAY LIFE

CROSS REFERENCE TO RELATED APPLICATIONS

This is a continuation-in-part of application Ser. No. 07/886,274 filed on May 20, 1992 now abandoned.

This invention relates generally to the switching of electrical loads and more specifically to microprocessor based switching controls.

In copending application Ser. No. 07/886,275 a control is described and claimed for controlling gas furnace systems. In accordance with the application the control circuit controls the heat speed and cool speed of a fan motor based on inputs from a room thermostat, a gas valve and a high limit switch. All the control inputs are 24 VAC signals which are inputted to a microprocessor through current limiting resistors and the IRQ input is connected to the 24 VAC transformer which is used to synchronize the readings of the 24 VAC input signals based on an input routine which executes as an IRQ interrupt routine and reads the inputs at the peak of the AC signal. The output is executed based on the Real Time Clock which operates on the internal oscillator and is asynchronous to the 60 hertz line frequency so that the relay contacts which are energized and de-energized in response to the microprocessor output are opened and closed randomly in order to enhance the life of the relay contacts.

It is an object of the present invention to provide even further enhanced relay contact life for resistive loads as well as inductive loads.

It is another object of the invention to provide a microprocessor switching control which is of relatively low cost, reliable and one which results in improved relay contact life.

BRIEF SUMMARY OF THE INVENTION

Briefly, in accordance with the invention, low voltage AC control inputs are inputted to a microprocessor along with an input from AC common to the IRQ input port of the microprocessor to synchronize the readings of the low voltage AC signals. In accordance with a first embodiment, when the invention is used for the switching of resistive loads, a first time constant corresponding to the amount of time which occurs between an output signal of the microprocessor to energize a relay to move the contacts into engagement and the time that the contacts actually come into engagement is used to derive a first time delay which is used with the status of the wave determined through the IRQ port to effect the closing of contacts synchronously at a selected point of the AC wave form, viz. at or shortly before a zero crossing (zero voltage across the contacts). Preferably, switching is chosen to occur just before zero crossing to allow for any contact bouncing and using the slight arcing to maintain the contacts in a clean condition. In like manner a second time constant corresponding to the amount of time which occurs between an output signal of the microprocessor to de-energize a relay to move the contacts into disengagement is used to derive a second time delay which is used with the status of the wave determined through the IRQ port to effect the opening of contacts at the selected point of the AC wave form.

In accordance with a modified embodiment contact switching is alternated between polarities every other occasion of contact switching and in another embodiment polarities are alternated on a random basis to optimize even wear and cleaning of the contacts with any small arc which occurs.

According to another modification a feedback network is provided in which a signal of energization of the load is fed back to the microprocessor through an optical isolator and the time is counted through the Real Time Clock between the time the microprocessor generated the output signal and the time the load energization signal was received to derive the actual time constant of a specific relay. Each of the relays of the system are calibrated upon initialization of the control.

When used with inductive loads such as the fan motors referred to in application Ser. No. 07/886,275 the time constant for closing contacts is used to energize the relays synchronously to move the contacts into engagement; however, de-energizing of the relay to move the contacts out of engagement is effected asynchronously as described in the referenced copending application. Alternatively, contact disengagement can be effected synchronously by using a current sensor to determine the actual zero crossing of the current wave or in relatively simple applications by calculating the power factor.

BRIEF DESCRIPTION OF THE DRAWINGS

FIG. 14 is a memory map;

FIGS. 15–17 are truth tables for heat and cool speeds and induced draft fans respectively;

DETAILED DESCRIPTION OF THE DRAWINGS

Figure 1:
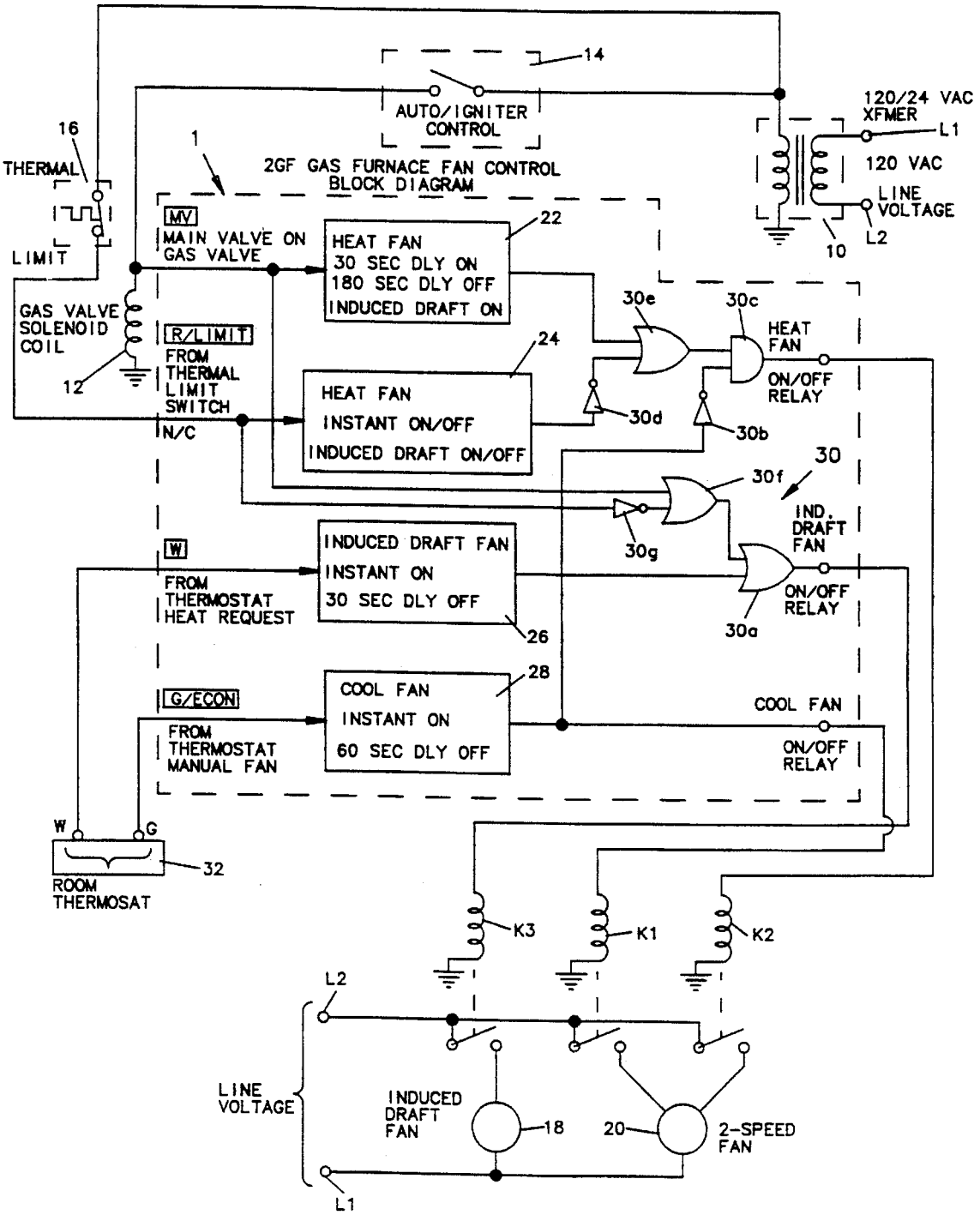
Fig. 1. PRIOR ART
FIG. 1 is a schematic of a prior art system in which a circuit board is shown by functions performed by the board.

With particular reference to FIG. 1 the several components of the system are shown along with a schematic representation of the functions provided by the control made in accordance with the invention.

A 120/24 VAC transformer 10 provides 24 volt AC power to a gas valve solenoid coil 12 and MV terminal on control board 1 through autoigniter control 14. The 24 volt AC power is also connected through a terminal limit 16 to R/Limit terminal on control board 1. Terminals W and G of a room thermostat 32 are connected respectively to terminals W and G/ECON on board 1.

An induced draft fan motor 18 and a two speed fan motor 20 are shown connected across line voltage L1, L2. Energization of fan motor 18 is controlled by a relay coil K3 from an output on board 1 and energization of cool speed and heat speed of fan motor 20 are controlled respectively from outputs on board 1 by relay coils K1 and K2.

Control board 1 is shown with functional blocks 22, 24, 26 and 28. Block 22, which receives an input from terminal MV, main valve, provides a heat fan energization signal with a selected time delay of 30 seconds on and 180 seconds off and an instantaneous induced draft fan energization. Block 24, which receives an input through normally closed thermal limit switch 16 provides a heat fan energization signal, instant on and off and induced draft fan energization, instant on and off. Block 26, which receives a heat request input from terminal W of room thermostat 32, provides an induced draft fan energization signal, instant on and a thirty second delay off. Block 28, which receives a manual cool fan request input from the room thermostat, provides a cool fan motor energization signal, instant on and a sixty second delay off.

Also shown in FIG. 1 are a group of symbols 30 used to describe the logic inter-relating the various inputs to provide the desired functional outputs which are actually provided in the software routines to be discussed below.

Thus a G signal received from the room thermostat turns on the cool fan instantly which remains on for sixty seconds after the signal is turned off at the room thermostat. A W or heat request signal from the room thermostat is shown going through an OR gate 30*a* results in the induced draft fan being turned on instantly and remaining on for thirty seconds after the W signal is turned off at the thermostat.

A G input is also shown connected through an inverter 30*b* to an AND gate 30*c* whose output is connected to the heat speed fan relay coil K2 so that an on or high signal from block 28 will be converted to a low signal being input to AND gate 30*c* indicating that a cool speed fan request will override a high speed fan request.

Thermal limit switch 16 is normally always energized providing a high input to block 24, which is inverted to a low through inverter 30*d*, and a normal low input to OR gate 30*e*. When autoigniter control 14 is energized a high will be inputted to block 22 which will result in a high output from OR gate 30*e* and, assuming a low cool speed fan signal, will result in a high from AND gate 30*c* thereby energizing relay coil K2 providing heat speed of fan motor 20. Energization of the gas valve 12 also provides a high input into OR gate 30*f* which in turn provides a high input to OR gate 30*a* to energize induced draft fan relay coil K3.

If thermal limit switch 16 opens because of a fault condition it provides a low input to inverter 30*g* which results in a high input to OR gate 30*f* thereby providing a high input to OR gage 30*a* and energization of induced draft fan motor 18. In addition, unless there is a signal call for cool speed of fan motor 20 then the opening of thermal limit 16 will cause energization of heat speed fan relay coil K2 by providing a low input to inverter 30*d* which is changed to high input to OR gate 30*e* and a high input to AND gate 30*c*.

Figure 2:
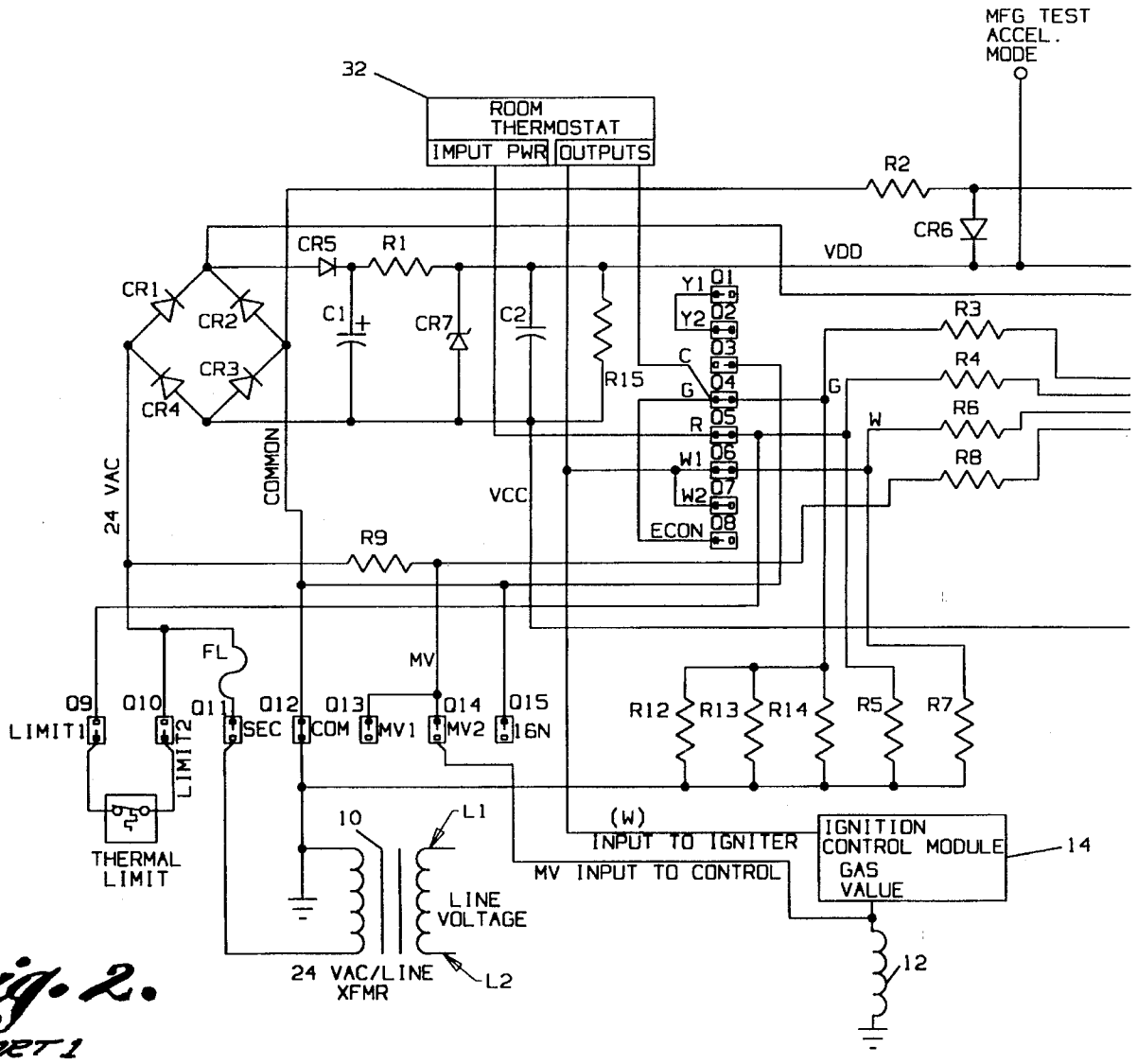
FIG. 2 is a schematic of the FIG. 1 system which can also be used with the switching system of the invention and showing the structural components of the circuit board.
Figure 2A:
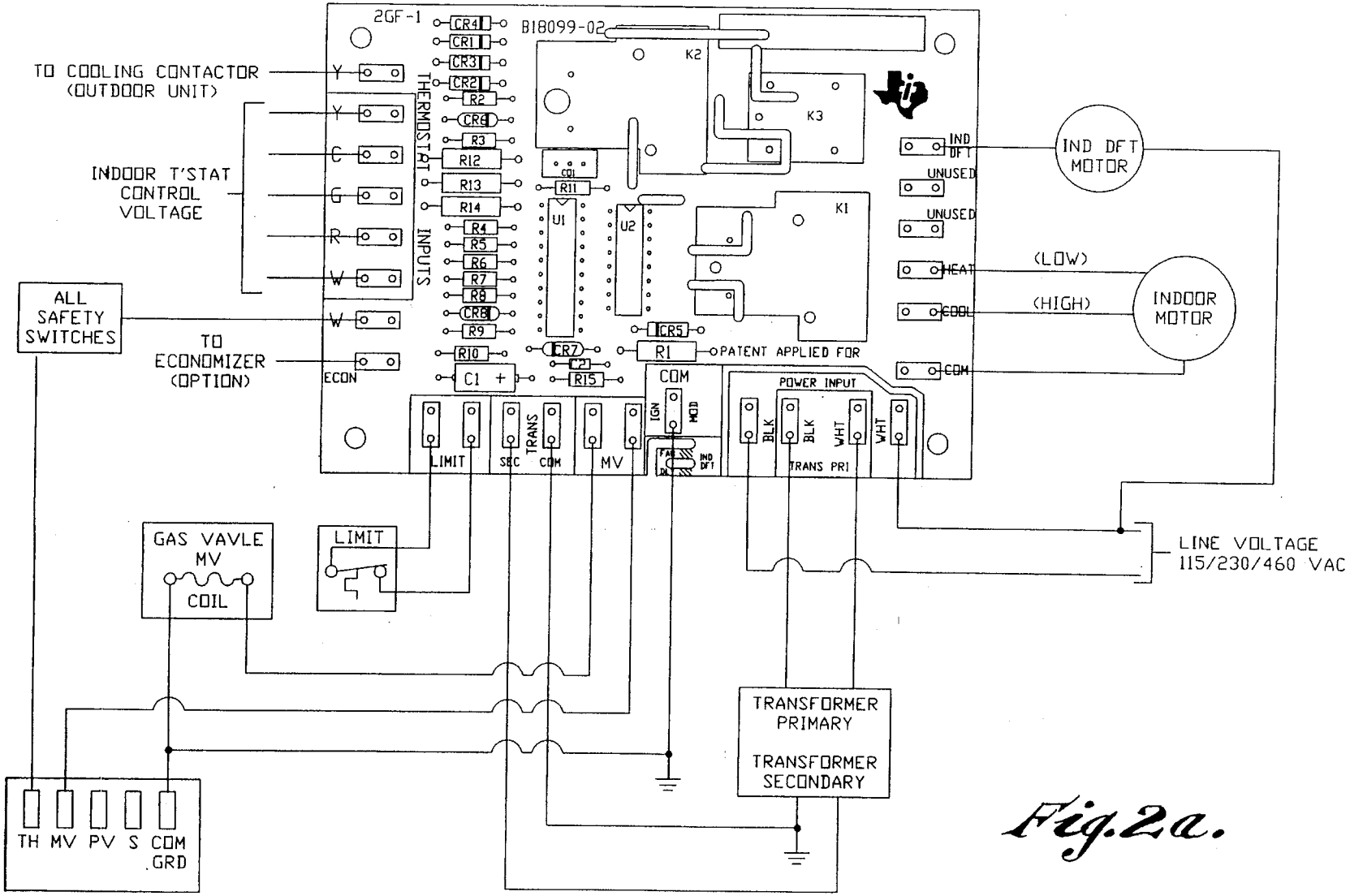
FIG. 2*a* shows the circuit board layout along with the connections to the several system components.

Turning now to FIG. 2 a schematic representation is shown of a control circuit along with other components of a gas furnace system with which the control circuit is used and to FIG. 2*a* in which the circuit board layout, as well as connections to the several system components, is shown. Transformer 10, providing 24 volts AC from line voltage, is connected at the 24 VAC output side to connector Q11 and then through a 5 amp fuse F1 to a full wave bridge comprising diodes CR1, CR2, CR3 and CR4. The transformer common is connected to the bridge through connector Q12. The bridge provides full wave rectified 24 VAC power to drive relays K1, K2 and K3 to be discussed below. Zener diode CR7 suppresses back EMF. Capacitor C2, resistor R15 and capacitor C1, resistor R1 provides 5 volts DC on line VDD for the power supply of microprocessor U2 to be discussed below.

There are several low voltage AC input terminals labeled Y1, Y2, C, G, R, W1, W2 and ECON. Terminals Y1, Y2 are not used in the present embodiment. Terminal C is connected to the transformer common, terminal G is coupled to an output of room thermostat 32 and to input port 3 of microprocessor U2 through a 100 ohm resistor R3 and is connected to common through pull down resistors R12, R13, R14 of 1.5 ohms connected in parallel to provide an equivalent resistance of 500 ohms. Terminal G is also connected to the terminal ECON. A signal on the G terminal results in energizing the manual fan as well as providing a cool request as will be explained further below. Terminal W1 is coupled to an output of room thermostat 32 and to the ignition control module 14, the other side of which is connected to common through the gas valve relay coil 12 and to connector Q14. Terminal W1, interconnected with terminal W2, is connected to input port 5 of microprocessor U2 through limiting resistor R6 of 100K ohms and to common through pull down resistor R7 of 50K ohms. Connector Q14 is connected to the 24 VAC output of transformer 10 through 100K ohms pull up resistor R9 and to input port 6 of microprocessor U2 through limiting resistor R8 of 100K ohms. It should be noted that there is no separate pull down resistor required since the main valve itself serves as a pull down resistor. Pull up resistor R9 serves as a safety feature. That is, if for any reason, the gas valve is not correctly wired to the control circuit since there is no pull down resistor to common pull up resistor R9 will always provide a high input thereby turning the induced draft fan on.

Another input to microprocessor U2 is IRQ port 19 which is a common input received through 100K ohms resistor R2. Clamping diode CR6 connected between port 19 and the 5 volt supply VDD drops the input at 5 volts.

Microprocessor U2 has two additional, optional inputs provided by breakaway tabs 34, 36. Input port 15 is connected to the 5 volt supply VDD through breakaway tab 36 and to DC ground or common VSS through 10K ohms resistor R10. Normally the system provides a selected period of time that the draft fan is maintained in the energized condition after its energization signal has been removed. This occurs when port 15 is pulled high by its connection with the 5 volt supply VDD. However, if tab 36 is broken off resistor R10 will pull port 15 to ground providing a low. Then the draft fan is turned off at the same time its energization signal has been removed.

Similarly, port 17 is connected to the 5 volt supply VDD through tab 34 and to ground VSS through 10K ohms resistor R17. Tab 34 provides a pilot draft option.

Reference numeral 38 indicates a wiring point which is used for testing the control. That is, by placing a 5 volt DC input at point 38 the control is placed in a test mode in effect shortening all the normal time delays. Point 38 is connected to port 16 of microprocessor U2 and ground through 10K ohms resistor R16. DC ground VSS is also connected to ports 10 and 7 of microprocessor U2.

Output ports 11–14 are connected to relay driver integrated circuit U1 at pins 4, 3, 2 and 1 respectively. Relay drive U1 comprises a transistor network which, in effect, switches on relays K1, K2, K3 when the base of the transistors receive an input signal from microprocessor U2. Output pin 15 of relay driver U1 is connected to the coil of relay K3 which has a common contact connected to power connectors Q16, Q17 and a normally open contact connected to connector Q25.

Power connectors Q16, Q17 are connected to switching mechanisms in respective relays K1, K2, K3. Energization of the relay coil of relay K1 through output port 14 will cause the switch to connect power to terminal Q21, the cool speed of the fan motor. Energization of the relay coil of relay K2 through output port 16 will cause the switch to connect power to terminal Q22, the heat speed of the fan motor. Energization of the relay coil of relay K3 through output port 15 will cause the switch to connect power to terminal Q25, the induced draft fan motor.

An optional feature is shown at the dashed box identified by numeral 40 comprising resistor R18 serially connected to LED between pin 15 of relay driver U1 and common, pin 9. This feature provides a flashing or continuous LED based on the state of energization of relays K1–K3.

Resistor R11 or 39K ohms is connected to pins 1 and 2 of microprocessor U2 to provide a selected rate of oscillation for the internal clock.

The control board is provided with terminals Q9 and Q10 to connect the high limit switch. The high limit switch is normally closed but adapted to open upon an over-temperature condition. An economizer function is tied to terminal G. This can be used as an output in a system having an economizer, i.e., an option which, for example, opens a duct to outside fresh air when the manual fan is on.

Figure 3:
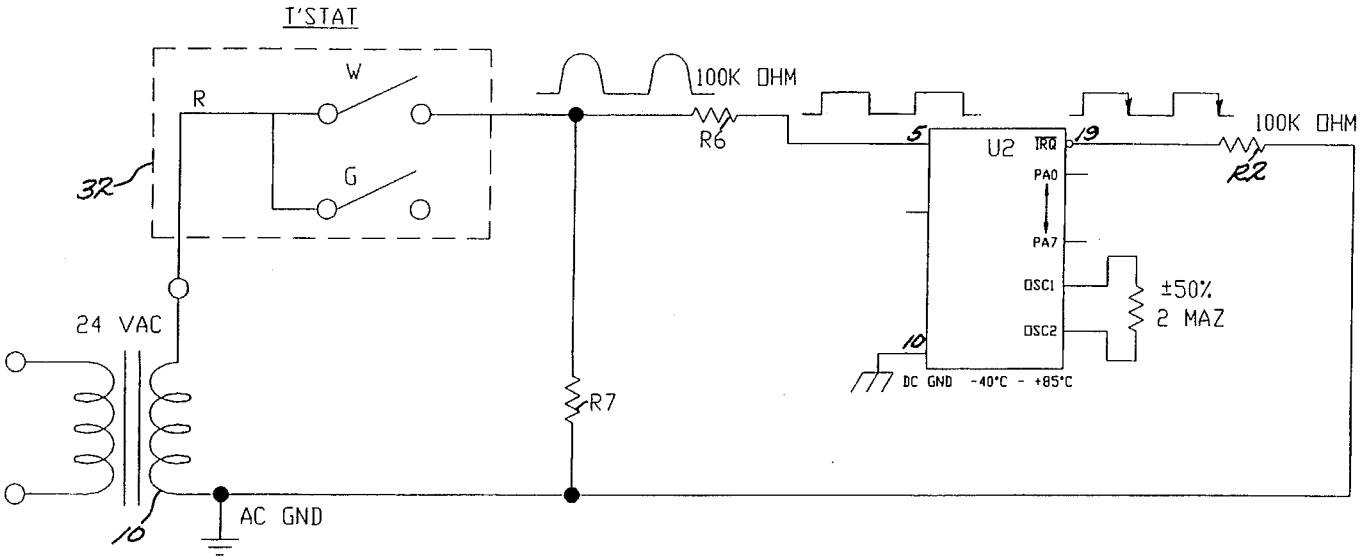
FIG. 3 is a simplified version of FIG. 2 showing one of the AC input signal lines and the microprocessor and several wave forms.
Figure 3A:
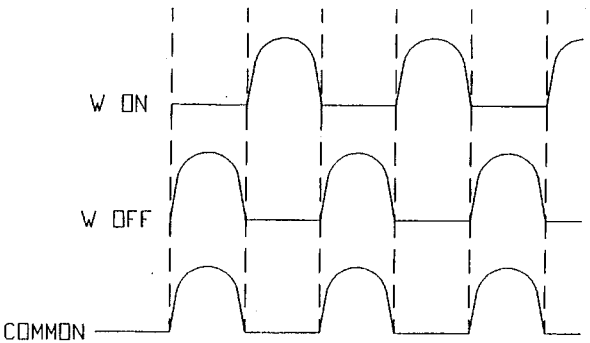
FIG. 3*a* depicts wave forms relating to FIG. 3.

With reference to FIG. 3 which is a simplified portion of FIG. 2, one of the inputs will be described. With respect to the W terminal, due to the internal structure of the CMOS microprocessor which includes intrinsic diodes on both the P and N channels of the FET's which serve to limit input voltage to 5 volts, a simple current limiting resistor R6 can be inputted to port 5 of microprocessor U2 along with a resistor R7 tied to common. When the room thermostat 32 provides a heat request signal by connecting 24 VAC from transformer 10 a wave form on the W line is shown in FIG. 3*a* as $W_{on}$. When terminal W is not energized port 5 of the microprocessor is tied to common with its wave form shown at $W_{off}$, which is the same as common.

Figure 4:
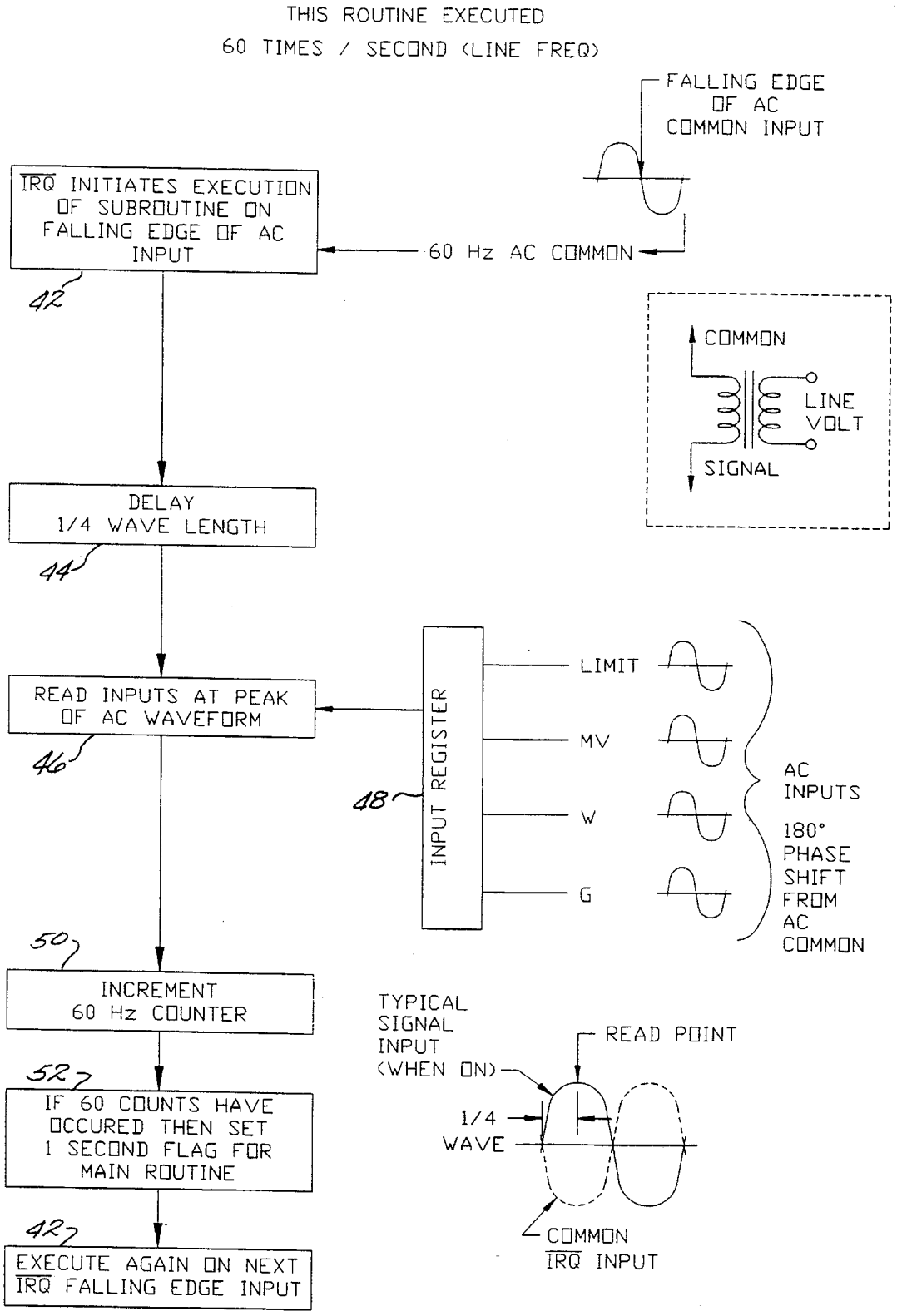
FIG. 4 shows key steps of calibration and input reading routine along with explanatory material inter relating signal and common wave forms.

The 5 volt DC ground coming from the diode bridge is shown at port 10. With respect to DC ground the microprocessor sees a half wave which, because of the diode clamping, is a square wave having the line frequency of 60 HZ, the phase of which depends on whether the W terminal is closed or open. When the terminal is closed the wave is 180° out of phase with the common voltage but when the terminal is open it is in phase with common voltage. In effect when the thermostat calls for heat a connection is made with the high side of the transformer, 180° out of phase with common, and when it does not call for heat the connection is with the common of the transformer. AC common is connected to port 19, the IRQ or special interrupt port of microprocessor U2 through resistor R2. As indicated in FIG. 4, at block 42 the IRQ initiates execution of a subroutine whenever it is exposed to the falling edge of an AC input. Thus, that routine is directly tied to common and is executed on every falling edge of the square wave. According to the routine, block 44, there is a delay of a quarter of a wave length and then the input port, in this case port 5, block 46, is read and inputted to the input register 48 for use in the main routine and a 60 HZ counter is incremented, block 50. After sixty counts, block 52, (i.e., one second) a flag is set so that the timing information can be transferred to the main routine. Thus, the subroutine is executed with the input register 47 updated on every falling edge of the 60 HZ wave.

The specific delay of a quarter of a wave length is determined by the relationship between the microprocessor clock and the AC clock or frequency. At the beginning of the main routine while the interrupt is masked a subroutine reads the Real Time Clock counter, then when the edge of the wave at port 19 goes high, an active low, the Real Time Clock is read. When the IRQ goes low again (one cycle of the 60 HZ later) the Real Time Clock is read again so that the number of clock pulses the oscillator has gone through during this cycle can be determined. The oscillator runs much faster, for example, in the order of 2 megahertz. The result, which varies from chip to chip is to synchronize the Real Time Clock and the line clock and derive how many oscillations are in a quarter cycle. Once this calibration routine is accomplished a clear interrupt is generated so that the IRQ input is enabled to start working in the main program reading the input signals at the high point of the signal wave.

The relays, when switched in accordance with the teaching of copending application Ser. No. 07/886,275, are actuated asynchronously in order to have the contacts close randomly with respect to the AC line wave so that the load is more evenly distributed on the contacts. This is effected by using the Real Time or internal clock. A real time interrupt which counts directly from the oscillations of the Real Time Clock sets a real time interrupt flag (RTIF) thereby generating an internal interrupt to execute a subroutine used for the output. When the real time interrupt flag is set the output section of the code is executed resulting in the asynchronous switching of the relay contacts.

Figure 5:
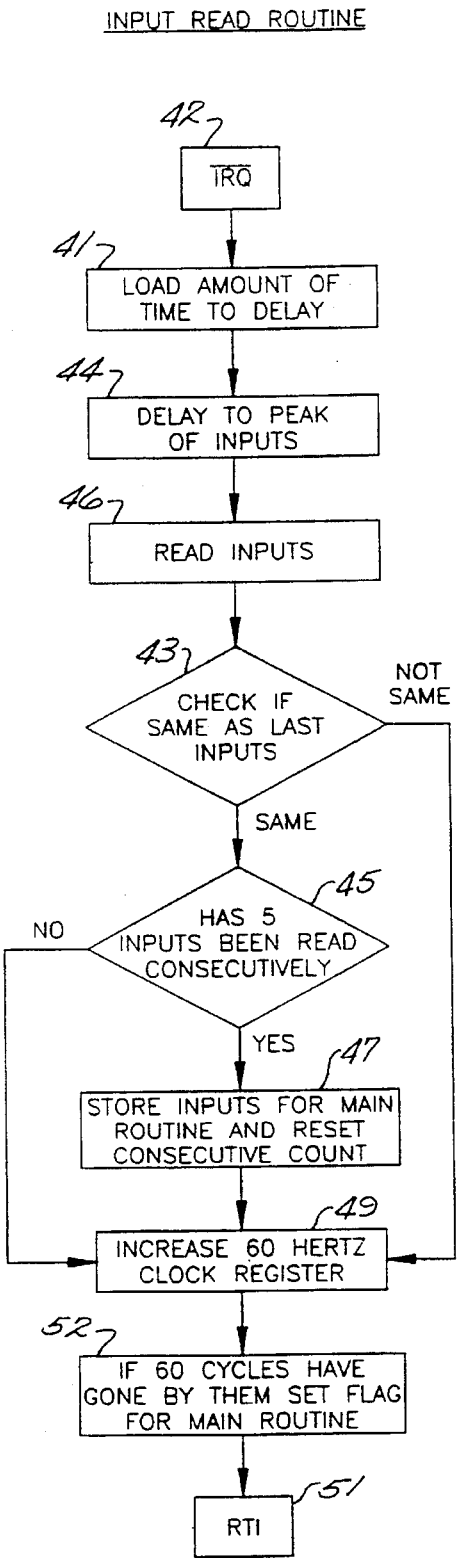
FIG. 5 is an input read routine.

With respect to the specific routines, FIG. 5 shows the input read routine wherein the inputs are checked in relation to previous inputs to see if a sufficient number of good inputs have been read and if so a flag is set for the main routine. The routine is initiated at 42 with the time delay to the peak of the input wave at 41, 44 and the input read at 46. A decision block 43 checks to see if the input is the same as the previous inputs and if not the routine goes to processing block 49 which increases the 60 Hertz clock register. If the inputs are the same it moves to decision block 45 to see if 5 inputs have been read consecutively and if not again jumps to processing block 49. If 5 inputs have been read consecutively it goes to block 47 storing inputs for the main routine and resets the consecutive count and then goes to block 49 and then, at blocks 51 and 52 sets flag for the main routine.

Figure 6:
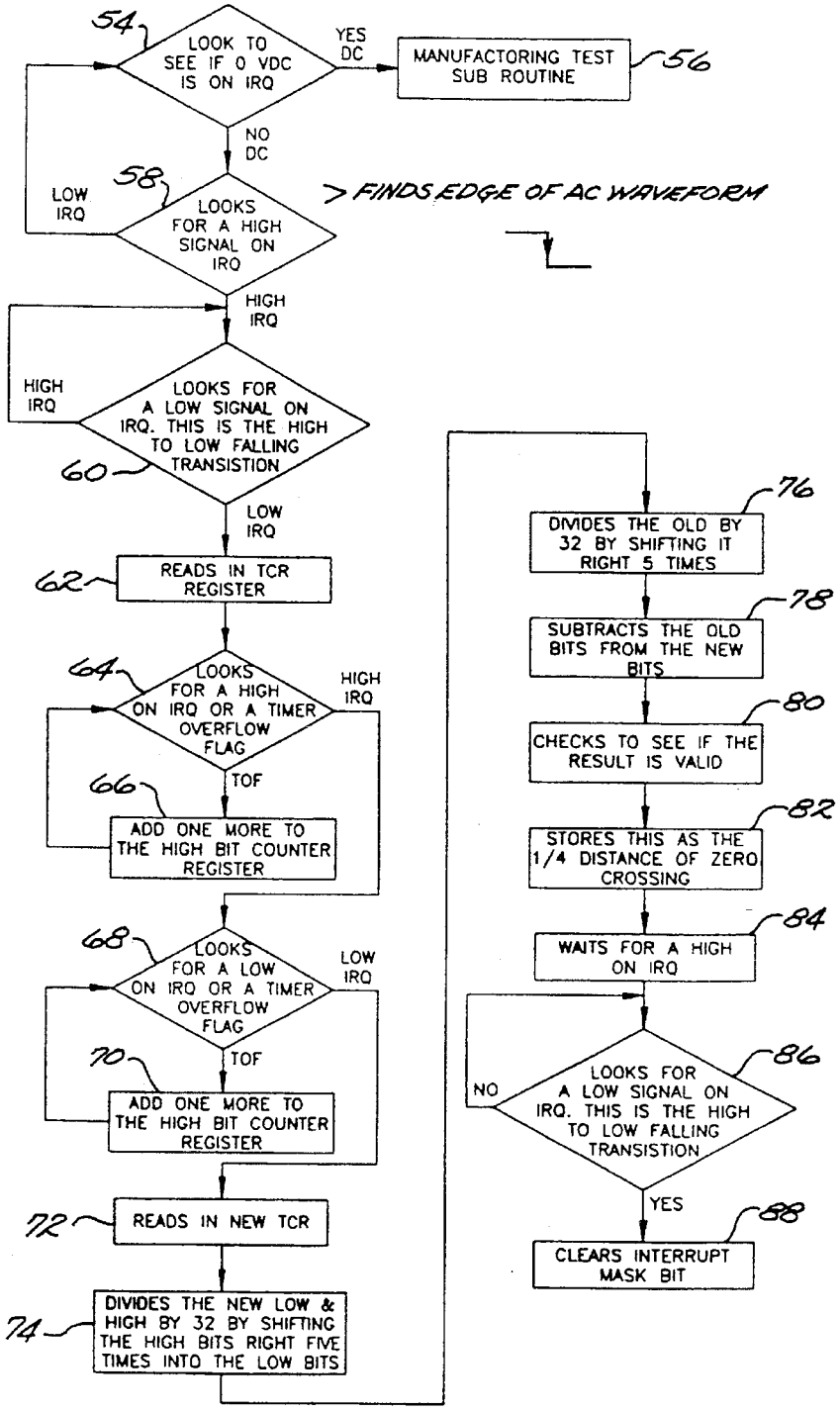
FIG. 6 is an input calibration routine.

FIG. 6 shows the flow chart of the input calibration routine in which the IRQ port waits for a low to high transition to find the wave edge which is then read in the TCR register. Since the Real Time Clock has limited capability, overflows are counted in order to derive a quarter wave delay time. Essentially the number of internal clock cycles are counted for one AC clock cycle to go from which the quarter wave delay time is derived. More specifically, the routine includes decision block 54 which checks to see if direct current is on IRQ port and if so goes into the manufacturing test subroutine 56 and if not goes to decision block 58 and looks for a high signal on IRQ port; if it is low it goes back to decision block 54, if it is high it moves to decision block 60 where it looks for a high to low falling transition, i.e., a low signal on the IRQ port; if it is high it cycles around until it finds a low signal and moves to processing block 62 and reads into the TCR register and goes to decision block 64 where it looks for a high on IRQ port or a timer overflow flag. If it finds a timer overflow flag it adds one more to the high bit counter register at block 66 and goes back to decision block 64. If it finds a high on the IRQ port it goes to decision block 68 where it looks for a low on the IRQ port on a timer overflow flag. If it finds a timer overflow flag it adds one to the high bit counter register at 70 and then goes back to decision block 68 and if it finds a low on the IRQ port it goes to block 72 and reads in new TCR and then to processing block 74 where it divides the new low and high by shifting the high bits right five times into the low bits and then to block 76 where it divides the old by 32 by shifting it right five times and in block 78 subtracts the old bits from the new bits and at processing block 80 checks to see if the result is valid and at block 82 stores this result as the one quarter distance from zero crossing and then, at block 84, waits for a high on the IRQ port. The routine then goes to decision block 86 and waits for a low signal, the high to low falling transition, on the IRQ port and then at 88 clears interrupt mask bit.

Figure 7:
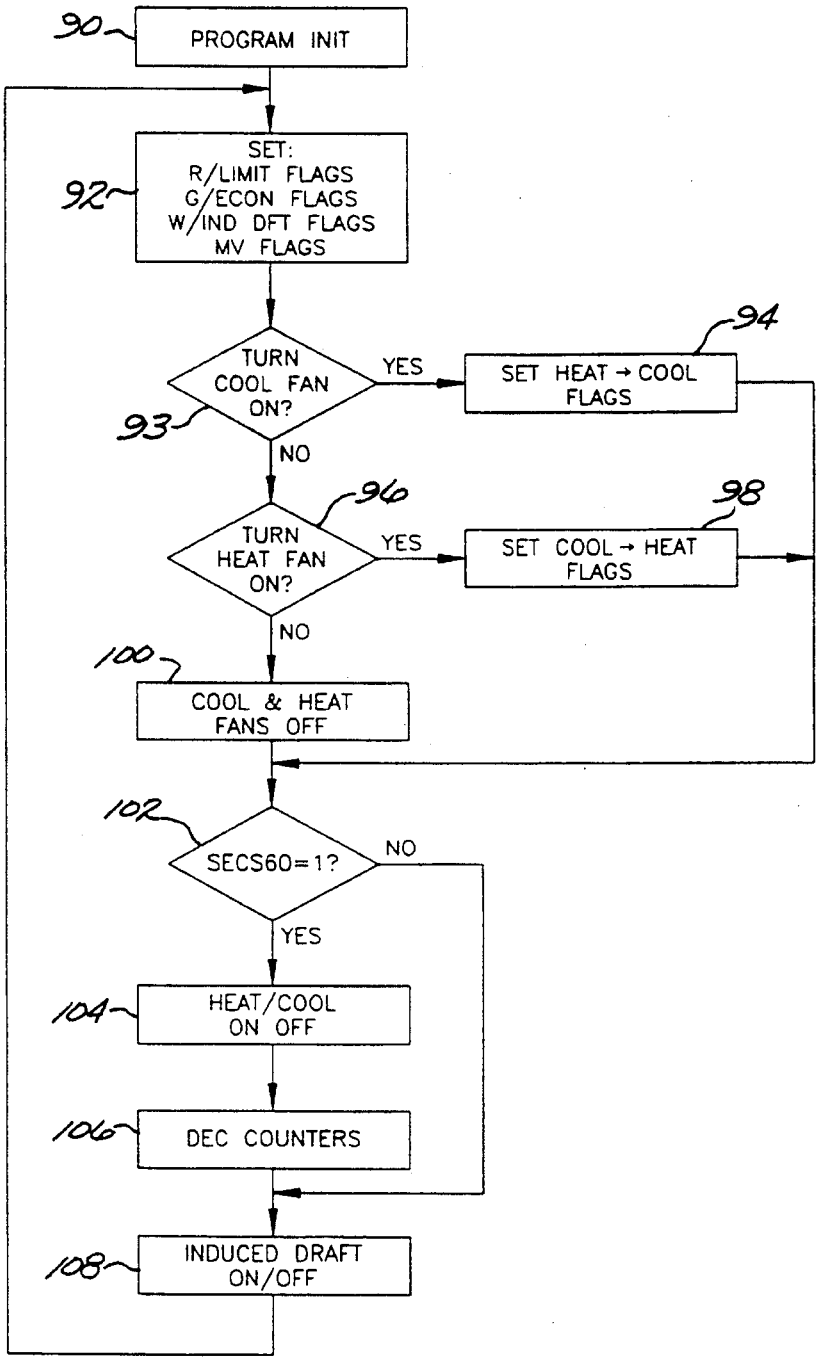
FIG. 7 is a main program overview.

FIG. 7 shows a simplified overview of the main program which assumes that everything is functioning as intended, i.e., the RTC (clock) is running, the interrupt routines are executing, etc. The routine is initiated at 90, it takes the inputs and sets condition flags at 92. Then a decision is made at 93 whether the cool fan needs to be on and if so a flag is set at 94 to make the heat to cool transition. If the cool fan is not called for a decision is made at 96 regarding the turning on of the heat fan. If yes, the cool to heat transition flag is set at 98. If the heat fan is not called for then at 100 both heat and cool fans are off. It should be noted that the transitions are always set to avoid the possibilities that both receive a turn on signal at the same time. The routine then at decision block 102 looks to see if one second has passed and if not goes to block 108 every second the decrement counter is decremented turning the fans on and off as required at 104 and 106. The induced draft fan can be on at the same time the heat fan is on, therefore, it is not included in the sixty second routine. The flags are continuously checked but the induced fan is not turned on and off every second. If one of the flags is set, for example, a flag is set to change heat to cool, the first time through the routine heat speed receives an instruction to turn off for a second, then the next time through the instructions will be turn on the cool speed. This obviates contradictory signals. Whereas whenever the induced fan receives a signal to turn on it can do so without any delay.

Figure 8:
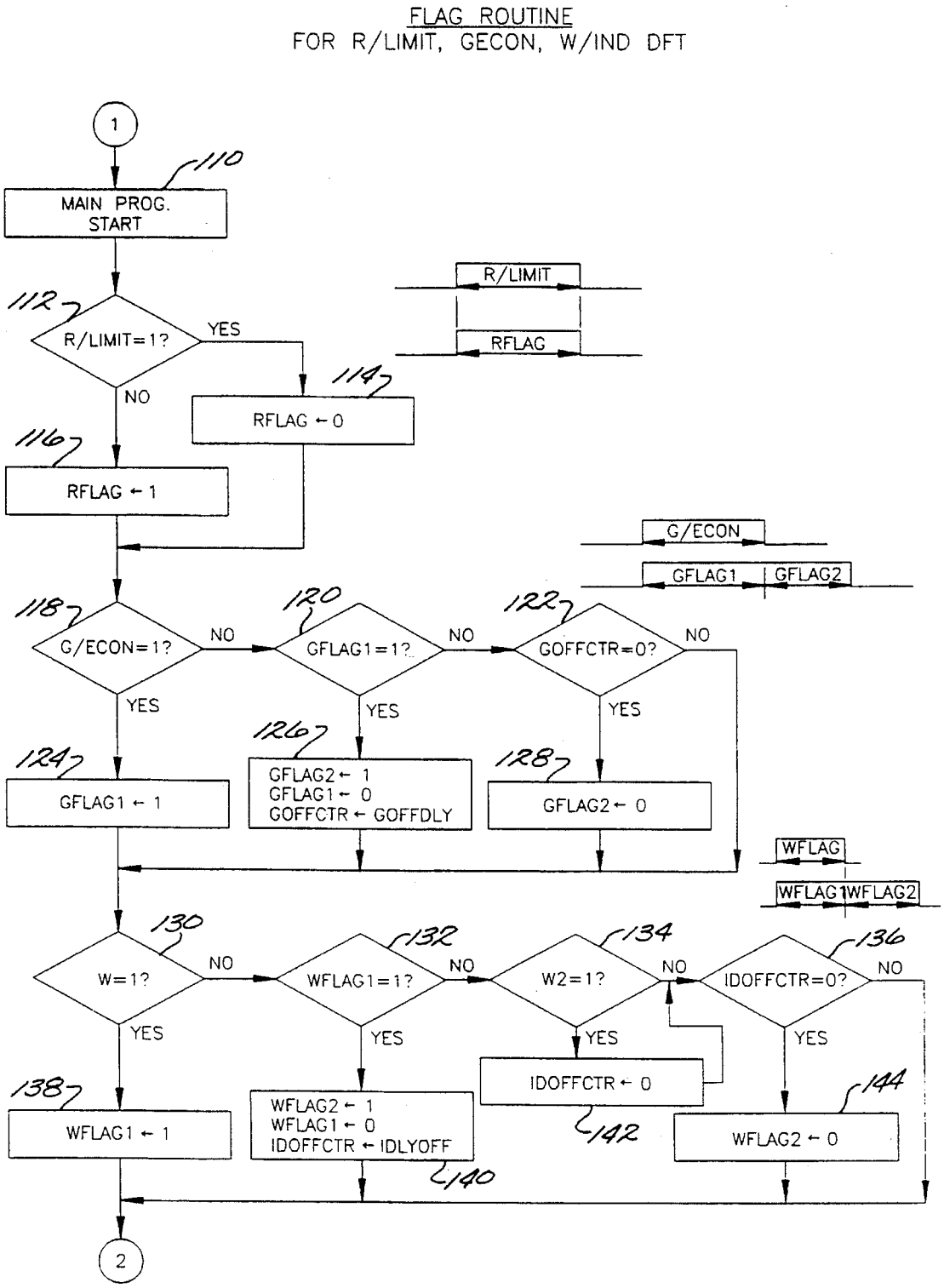
FIG. 8 is a flag routine for R/LIMIT, GECON; W/IND DFT.
Figure 9:
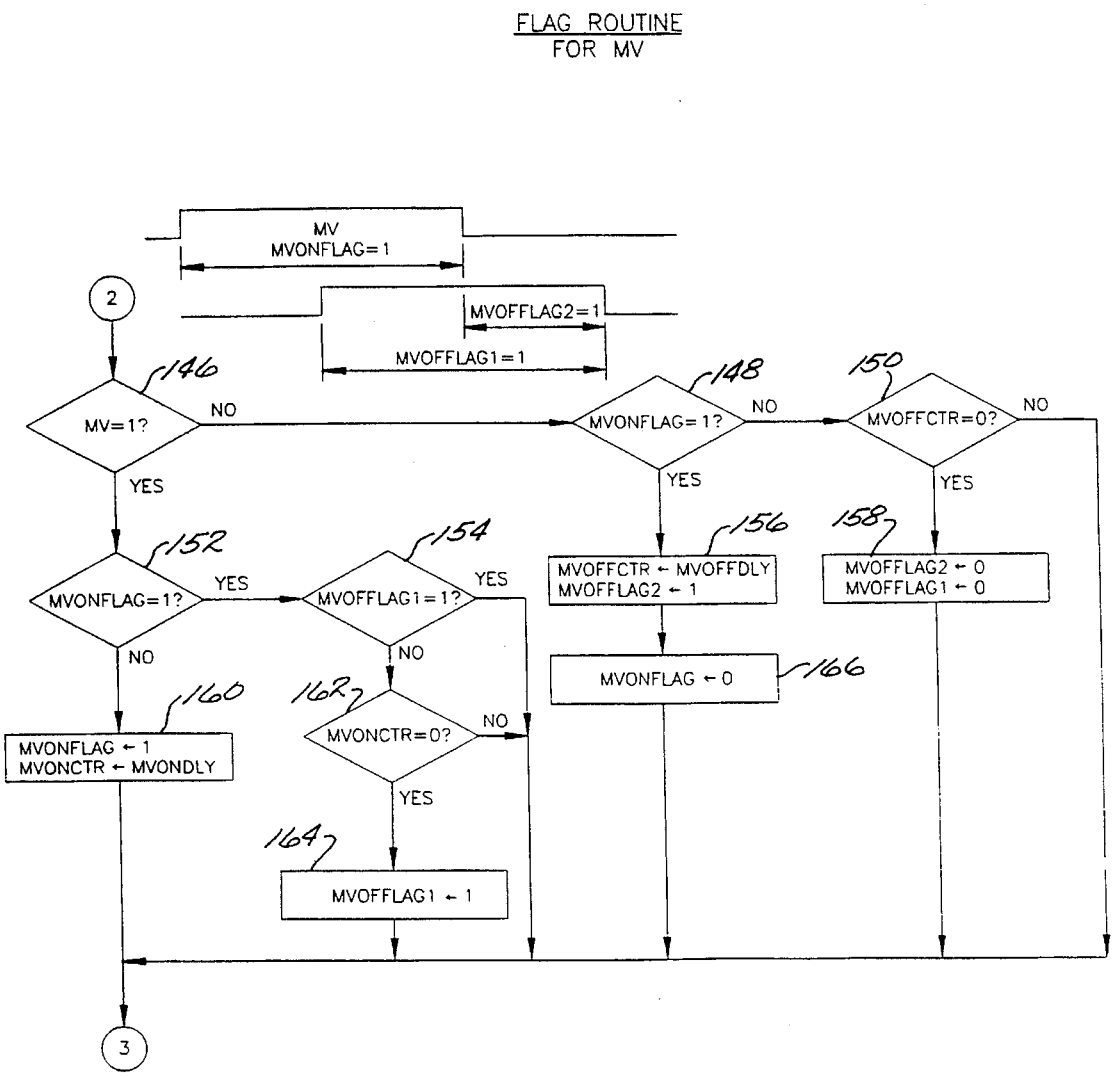
FIG. 9 is a flag routine for MV (main valve)

FIG. 8 shows the flag routine 110 for R/LIMIT, GECON and W/IND DFT and FIG. 9 for MV including decision and processing blocks 112–164 wherein the conditions of the limit flags are checked, what conditions they are in and where they have been in order to avoid the possibility of short cycling the routine and that the output routine has to finish completely. This is particularly important when some overlapping occurs, that is, competing signals for heat and cool speed fans. For example, the cool speed has a sixty second off delay and the heat speed a three minute off delay. The several flags keep track of these various conditions.

Figure 10:
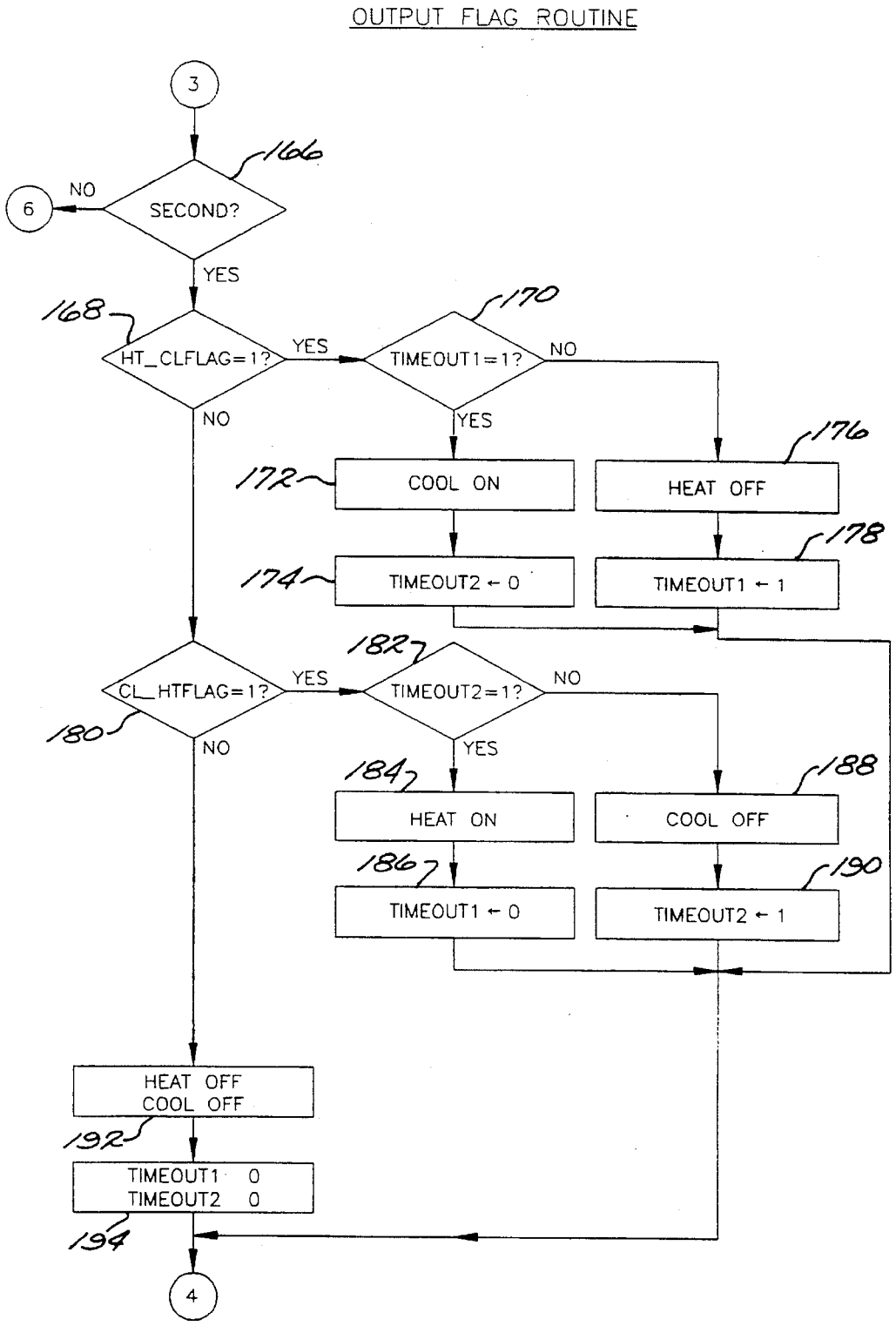
FIG. 10 is an output flag routine.

FIG. 10 relating to the output flag routine and including decision and processing blocks 166–194 ensures that the proper sequence of events occurs. That is, that the heat speed is turned off before the cool speed is turned on and the like.

Figure 11:
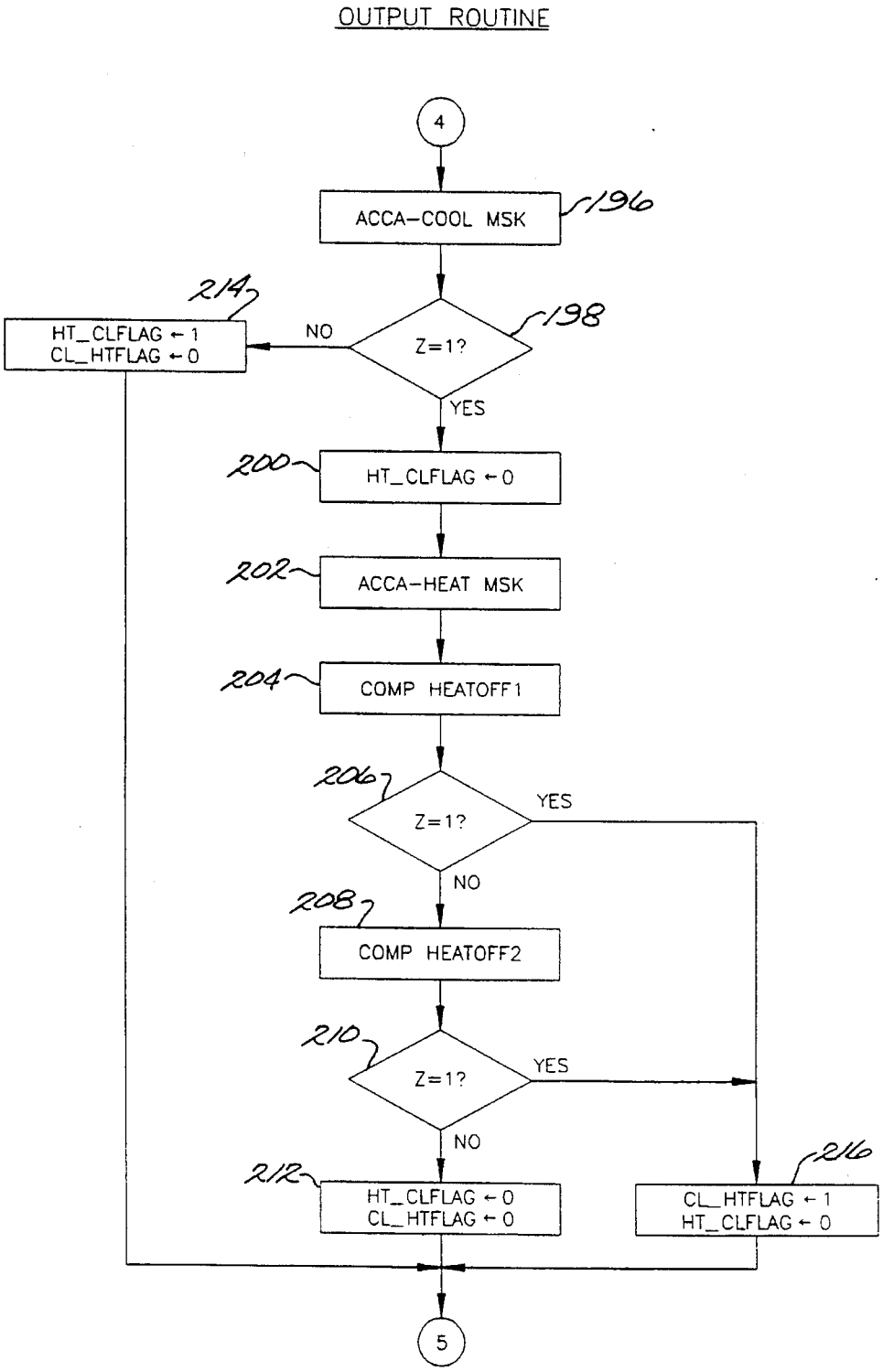
FIG. 11 is an output routine.
Figure 12:
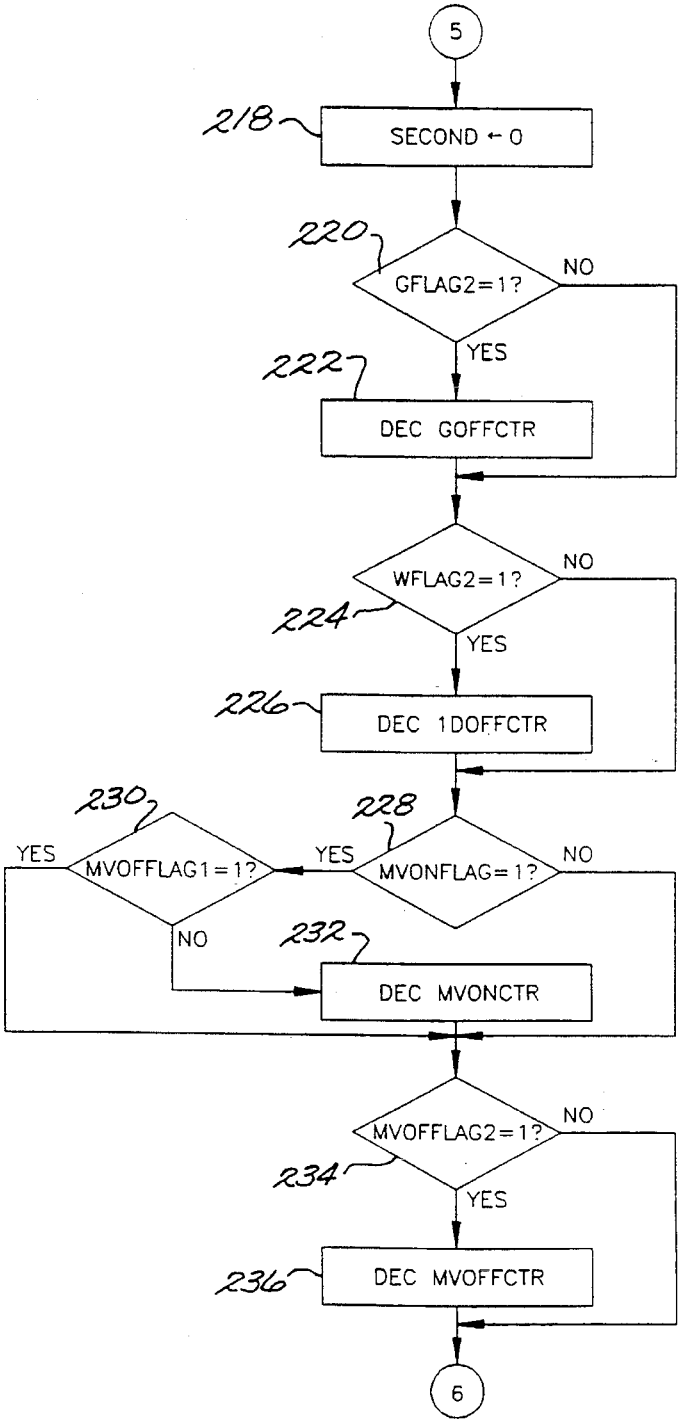
FIG. 12 is a counter routine.

FIGS. 11 and 12 show the output and counter routines respectively including decision and processing blocks 196–236 in which flags are set to transfer the output register in the art RTI interrupt routine. Based on the conditions determined by a flag, e.g., if in time delay off then the counter is decremented, if not, the routine skips to the next item.

Figure 13:
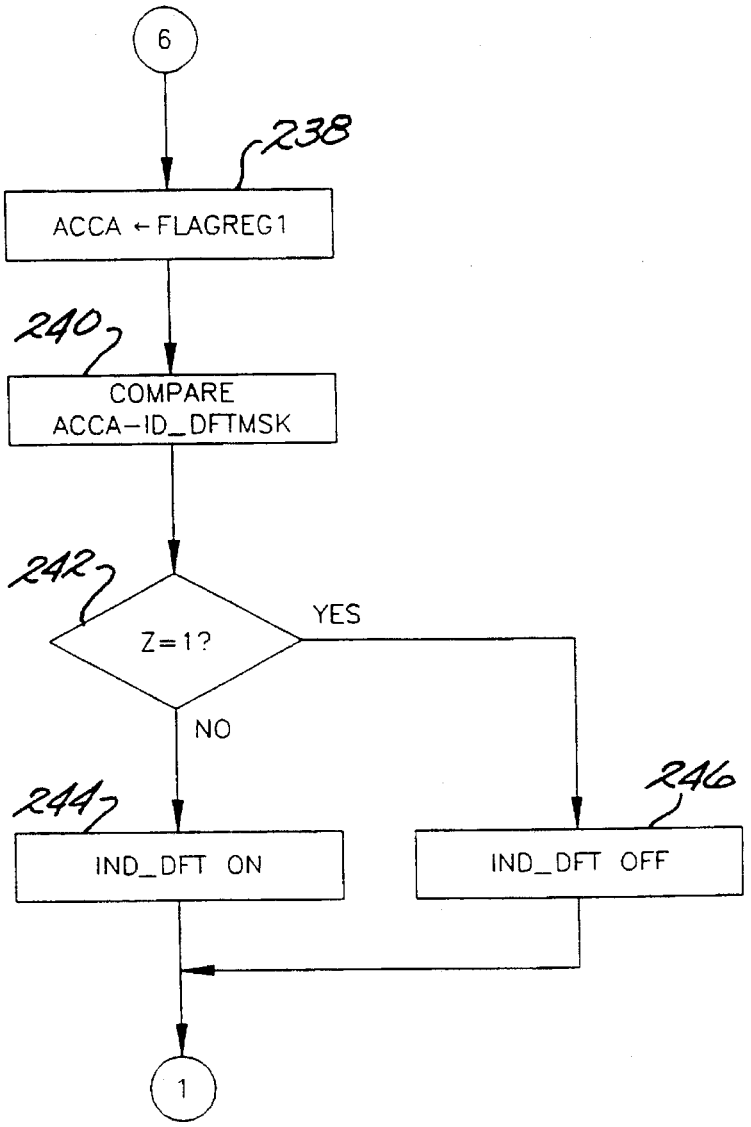
FIG. 13 is an induced draft output routine.

It will be seen in FIG. 13, relating to the induced draft output routine, that competing speeds are not factors so that the 1 second flags is not dealt with.

FIG. 14 shows the several counters and flags and their location in memory while FIGS. 15, 16 and 17 are truth tables of the inputs and outputs of heat and cool speeds and induced draft fan respectively.

A control circuit made in accordance with the FIG. 2 embodiment and shown in FIG. 2a comprised the following components:

| | | | | |
|---|---|---|---|---|
| R1 | 1.5K ohms 5% 1 W | R11 | 39K ohms 5% ⅛ W | CR7 5.0 V zener |
| R2 | 100K ohms 5% ⅛ W | R12 | 1.5K ohms 5% 1 W | CR1 - general purpose diode |
| R3 | 100K ohms 5% ⅛ W | R13 | 1.5K ohms 5% 1 W | CR2 - general purpose diode |
| R4 | 100K ohms 5% ⅛ W | R14 | 1.5K ohms 5% 1 W | CR3 - general purpose diode |
| R5 | 50K ohms 5% ⅛ W | R15 | 10K ohms 5% ⅛ W | CR4 - general purpose diode |
| R6 | 100K ohms 5% ⅛ W | R16 | 10K ohms 5% ⅛ W | CR5 - general purpose diode |
| R7 | 50K ohms 5% ⅛ W | R17 | 10K ohms 5% ⅛ W | CR6 - switching diode |
| R8 | 100K ohms 5% ⅛ W | C1 | 10 uf 63 VDC | U1 - MG8HC05J1 Motorola |
| R9 | 100K ohms 5% ⅛ W | C2 | .1 uf 50 VDC | U2 - ULN 2003A Texas Instruments |
| R10 | 10K ohms 5% ⅛ W | K1 | T90 - Potter & Brumfield | |
| | | K2 | T90 - Potter & Brumfield | |
| | | K3 | T90 - Potter & Brumfield | |

The above description relates to a furnace control system as disclosed in copending application Ser. No. 07/886,275 in which the relay contacts are switched into and out of engagement asynchronously relative to line voltage in a random manner in order to extend contact life. In accordance with the present invention, the relay contacts of the furnace control system are switched synchronously with regard to line voltage but in a manner which enhances contact life even further.

A finite time occurs between the time that a relay driver receives a signal to actuate a relay and the actual movement when the contacts of the relay move out of engagement, i.e., open, or move into engagement, i.e., close. It has been found that for a given relay this time constant is quite consistent and even from one relay to another with a narrower range in opening than in closing. That is, relay time is dependent upon an actuation spring which provides consistent timing over the life of the relay whereas the pull in time varies somewhat with temperature, voltage and the like. For example, a typical range of time constants for a group of relays for opening being between 1.9 and 3.0 milliseconds with a nominal time of 2.5 milliseconds and for closing between 6.5 and 10.5 milliseconds with a nominal time of 7.5 milliseconds. These values will change from one manufacturer to another but are typical.

Figure 18:
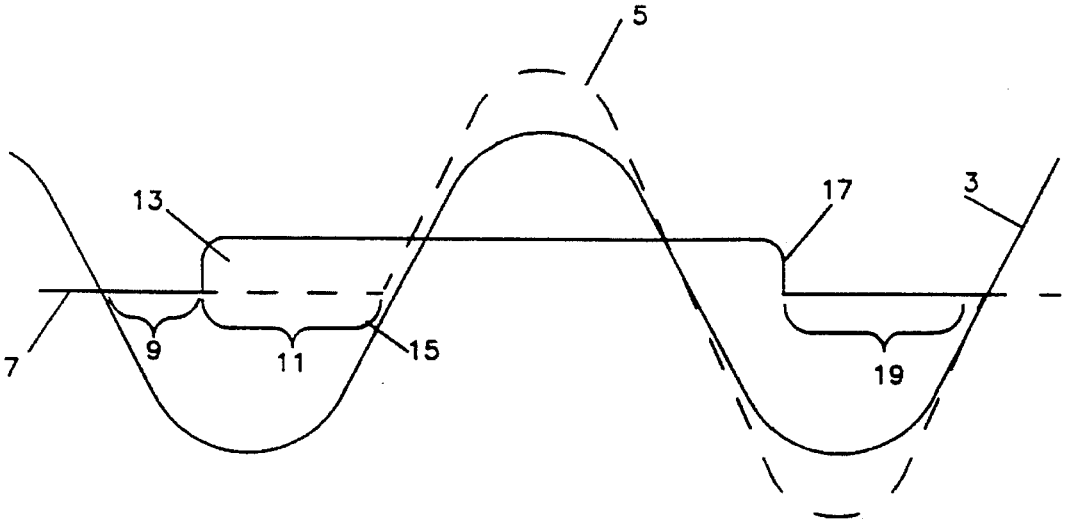
FIG. 18 is a sketch of an AC line voltage wave form and an output signal for energizing and de-energizing relay contacts in accordance with the invention.

In accordance with the invention the time constant is used as a time delay to allow for the mechanical action of the relay. Since the microprocessor has a direct input at the IRQ port indicating the status of the AC line voltage when relay energization and de-energization is called for and the IRQ interrupt sees a falling edge of the AC common, the output from the microprocessor to the relay driver U1 is delayed so that the contacts will operate at a selected point of the AC wave form, for example, slightly before the AC wave goes through zero to allow for any contact bouncing. For example, upon contact closing with a nominal pull in time of 7.5 milliseconds that time will be subtracted from the time of one half wave to result in contact engagement at the zero cross over. This can be seen in FIG. 18 which shows AC line voltage 3, load voltage 5 and the output signal 7 for energizing and de-energizing the relay contacts. The calibrated delay 9 based on the nominal pull in time 11 provides a trigger point 13 resulting in contact closing at 15. In like manner, the calculated off trigger point 17 and mechanical release time 19 provides opening of the contacts at zero crossing.

Significantly more damage to contacts occur on contact opening, and as mentioned above, the narrower range of time required for mechanical actuation occurs on contact opening which results in improved performance of the invention.

The specific delay period chosen is preferably selected so that contact engagement and disengagement occurs slightly before the zero crossing with whatever arc which occurs being extinguished at the zero point. In order to ensure that the worst case situation is dealt with the longest release time in the range for a group of relays is used, i.e., in the example described 3.0 milliseconds. If desired, a selected voltage threshold, such as 30 volts, can be used to derive the delay period. This allows a safety margin avoiding the situation of contact engagement or disengagement occurring just after the zero point in which the arc would not be extinguished for essentially another half cycle at the next zero crossing.

Since a minimal amount of arcing is likely to occur between the contacts it is preferred to distribute the arc as evenly as possible between a given set of contacts. In so doing this will actually serve to maintain the contacts in a clean condition. This can be accomplished by alternating the switching between the two polarities. Thus, for resistive loads, such as electric heating, the calculated time delay for switching is increased by half a wave length every other time on both on and off switching. For inductive loads, such as motors, this type of switching is only effected on contact engagement and switching off is effected asynchronously in the same manner as described and claimed in the copending application Ser. No. 07/886,275 due to the difficulty in establishing the precise zero crossing of the current wave.

In a modified embodiment the polarity at which switching occurs, on and off for resistive loads and on for inductive loads, is continually changed by randomly adding an offset to the relay time constant. The offset is equal to half of the time period of the incoming AC line wave. To ensure that the offset is randomly applied, the logic uses the internal microprocessor clock, i.e., the Real Time Clock. The offset is added to the delay period based on the status of the Least significant Bit of the Real Time Clock. This feature of adding the offset randomly provides the advantage that the previous switching polarity can be ignored and does not need to be committed to memory. This allows the microprocessor to have hardware resets and reinitialize itself without being concerned with losing the polarity offset information.

Alternatively, for inductive loads, a current sensor can be used to provide an input to the microprocessor so that an interrupt can be generated on the falling or rising edge of the current wave. In less complicated applications of inductive loads an approximation of the power factor could be used to derive the calculated time delay.

Figure 19:
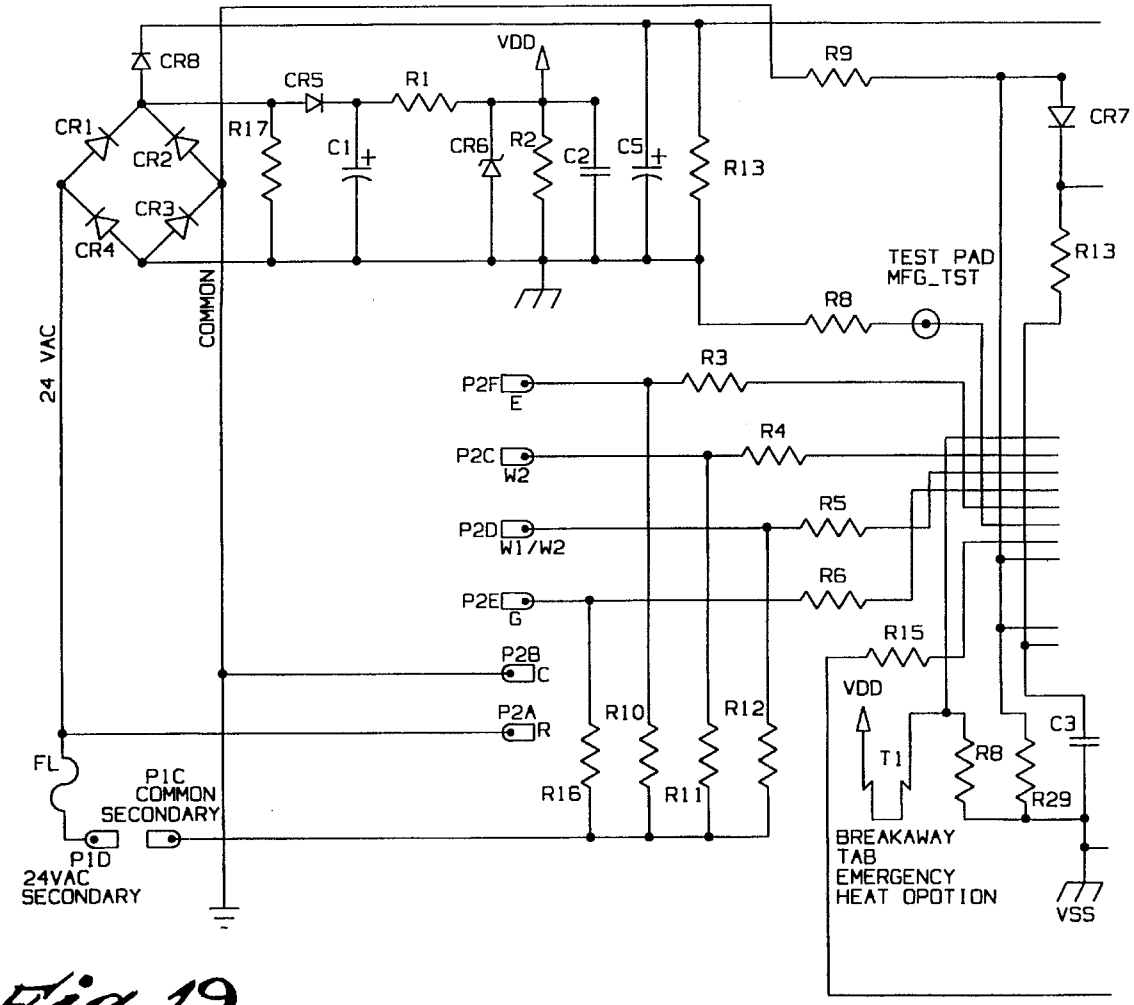
FIG. 19 is a schematic similar to FIG. 2 which includes a feedback network for calibrating the time constant of the relays.
Figure 20:
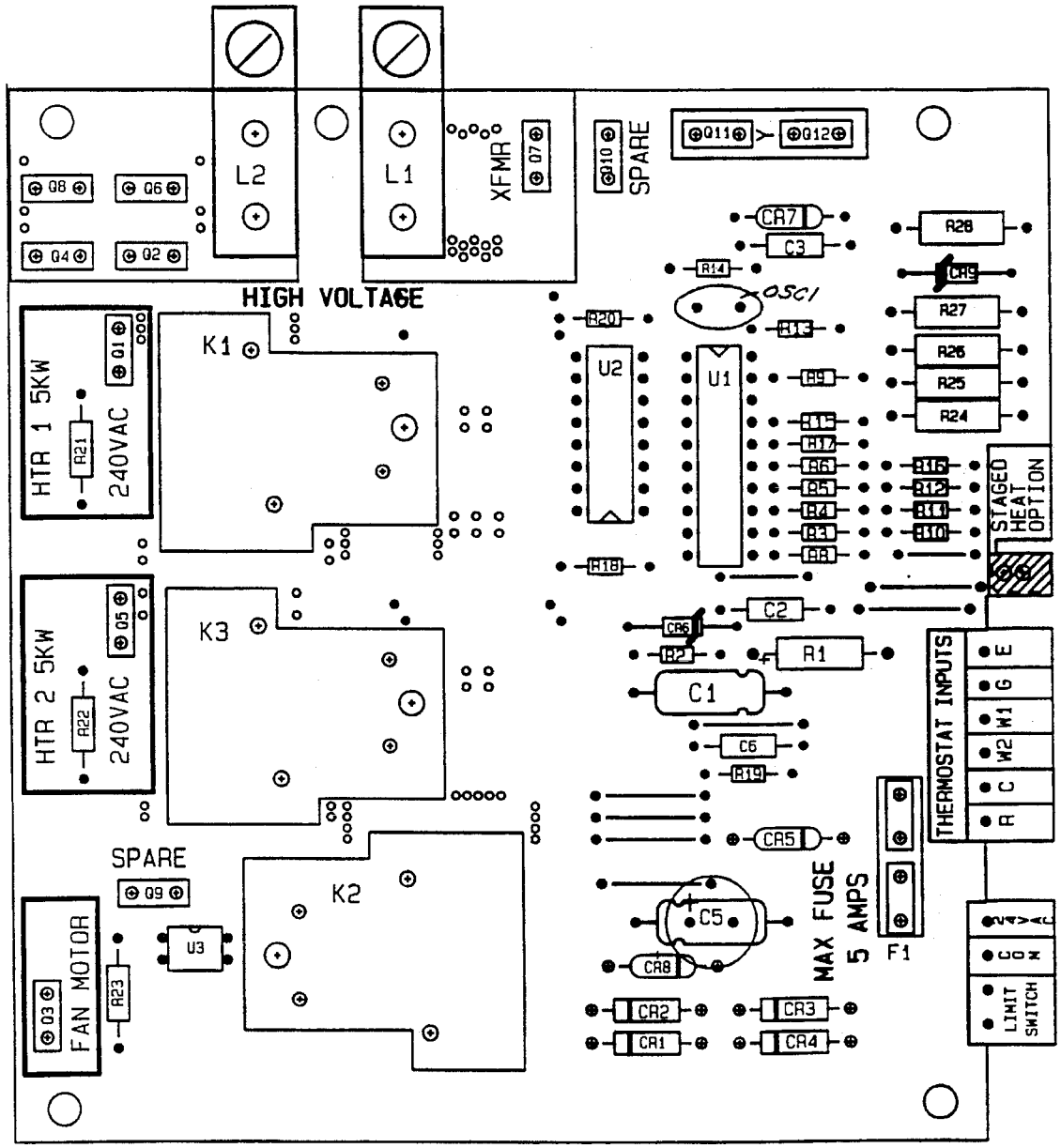
FIG. 20 shows a circuit board layout of FIG. 19 similar to FIG. 2*a*.

By adding a feedback from the relays back to microprocessor U2 each relay can be calibrated and a specific delay period unique to each relay can be derived. A control circuit of this type is shown in FIGS. 19 and 20. FIGS. 19 and 20 are similar to FIGS. 2 and 2*a* so that the description of the basic circuit will not be repeated. With respect to the feedback, an optical isolator PS2505-1 has an input connected to terminal Q8, the 240 VAC transformer common and to each load at terminals Q5, Q3 and Q1 through resistors R21, R22 and R23 respectively. The output is connected to port PB5 of microprocessor U2 and between VDD and DC ground VSS through parallel coupled resistor R19 and capacitor C6. The control side of relays K1, K2 and K3 is connected to input port PA1 of microprocessor U2 through resistor R28 and to DC ground VSS through parallel coupled resistors R24, R25, R26, R29 and a 30 VDC zener diode CR9.

When an output signal calling for relay energization is generated by microprocessor U2 there is a direct feedback to the input of microprocessor U2. This time is counted and the trigger point is then derived thereby calibrating each relay as it is actuated. More specifically, when the microprocessor generates an output signal calling for energization of a relay the signal is fed back to input port PAl of the microprocessor which serves as a starting point for counting. Another signal indicating energization of the relay contacts is received from line voltage through respective resistor R21, R22, R23 and the optical isolator causing the output of the optical isolator to send a low voltage signal back to the microprocessor as in input signal which serves as an ending point for the counting. The microprocessor individually turns each relay on and off on initialization of the control to calibrate the relays. It will be understood that, if desired, separate optical isolation could be provided for each relay so that one could dynamically calibrate the relays synchronously each time they were operated to provide even greater reliability. When using the single optical isolator shown in FIG. 19 it is preferred to calibrate the relays only on initialization since they are operated asynchronously.

The additional components shown in FIGS. 19 and 20 relative to FIGS. 2 and 2*a* in a control made in accordance with the invention are as follows:

| | | | |
|---|---|---|---|
| R19 | 10K ohms - ⅛ W | C3 | .1 uf - 50 VDC |
| R20 | 10K ohms - ⅛ W | C5 | 100 uf - 63 VDC |
| R21 | 68K ohms - 1 W | C6 | .1 uf - 50 VDC |
| R22 | 68K ohms - 1 W | CR9 | 30 VDC |
| R23 | 68K ohms - 1 W | Opto-isolator | - PS2505-1 |
| R24 | 2K ohms - 1 W | | |
| R25 | 2K ohms - 1 W | | |
| R26 | 2K ohms - 1 W | | |
| R27 | 2K ohms - 1 W | | |
| R28 | 1.5K ohms - 1 W | | |
| R29 | 51K ohms - ⅛ W | | |

FIG. 20 shows the specific placement of the connectors and components on a circuit board embodying the FIG. 19 circuit.

Numerous variations and modifications of the invention will become readily apparent to those familiar with furnace controls. The invention should not be considered as limited to the specific embodiments depicted, but rather as defined in the claims appended hereto.

What is claimed:

1. A switching system for switching AC line current including relay means having relay contacts which are relatively movable into and out of engagement with one another comprising, transformer means for providing a low voltage AC source and having a transformer AC common, means coupled to the low voltage AC source for providing low voltage AC input signals, microprocessor means having signal input ports and an IRQ interrupt input port and output ports, the transformer common coupled to the IRQ interrupt port, means for the microprocessor to read the AC input signals when the wave is at a peak, the output ports of the microprocessor being coupled to the relay means, the relay means having a given time constant for performing the mechanical operation of moving the contacts into engagement with one another measured from the time that the relay means receives a signal calling for the contact engagement operation, means to derive a delay time for generating a microprocessor output to the relay means following an input signal at one of the signal input ports by subtracting a selected fixed time constant from one half the AC line voltage wave length and means generating an output from the microprocessor to the relay means at a time equal to the delay time following a zero crossing of the AC line voltage wave so that contact engagement will occur in the proximity of zero crossing of the AC line voltage, the selected fixed time constant for the relay means falling within a tolerance range of given time constants derived for a group of relays from a maximum given time constant of the group to a minimum given time constant of the group and the delay time being derived based on use of the maximum given time constant as the selected fixed time constant so that contact engagement for any relay within the group will generally occur prior to zero crossing of the AC line voltage.

2. A switching system according to claim 1 including means for adding additional delay time of one half AC line voltage wave length to the said delay time on a random basis whereby switching polarity for contact engagement will be continuously changed to enhance contact life.

3. A switching system according to claim 2 in which the microprocessor means has a Real Time Clock and the additional delay time of one half AC voltage wave length is derived from the Real Time Clock.

4. A switching system according to claim 1 in which relay driver means is coupled between the output ports of the microprocessor and the relay means.

5. A switching system according to claim 1 in which the delay time is derived so that contact engagement will occur at approximately 30 volts.

6. A switching system according to claim 1 in which the relay means has a second given time constant for performing the mechanical operation of moving the contacts out of engagement with one another measured from the time that the relay means receives a signal for the contacts disengagement operation, and means to derive a second delay time for generating a microprocessor output to the relay means following an input signal at a signal input port by subtracting a selected second fixed time constant from one half the AC line voltage wave length and means generating an output from the microprocessor to the relay means at a time equal to the second delay time following a zero crossing of the AC line voltage so that contact disengagement will occur in the proximity of zero crossing of the AC line voltage wave.

7. A switching system according to claim 6 in which the selected second fixed time constant for the relays fall within a tolerance range for a group of relays from a maximum second given time constant of the group to a minimum second given time constant of the group and the selected second fixed time constant is derived based on the use of the maximum second given time constant as the selected second fixed time constant so that contact disengagement for any relay within the group will generally occur prior to zero crossing of the AC line voltage wave.

8. A switching system according to claim 6 in which the selected second fixed time constant is derived so that contact disengagement will occur at approximately 30 volts.

9. A switching system according to claim 6 in which the switching system is used with inductive loads including means for adding an additional delay time of one half AC line voltage wave length to the said delay time on a random basis whereby switch polarity will be continuously changed for contact engagement but not for contact disengagement.

10. A switching system according to claim 1 in which the means for the microprocessor to read the AC input signals when the wave is at a peak includes a subroutine executed on the falling edge of the AC common in which reading of the AC input signals is delayed one quarter of a wave length.

11. A method for switching AC line current in a system including relays with relay contacts, a microprocessor for receiving low voltage AC input signals and providing output signals to operate the relay contacts to move into engagement and disengagement in response to the input signals, the relays having a first given time constant equal to the time used in the mechanical operation of moving the contacts into contact engagement and a second given time constant to the time used in the mechanical operation of moving the relay contacts into disengagement, the microprocessor having a Real Time Clock and an IRQ interrupt input port and transformer means for providing a low voltage source and having a transformer AC common and means coupled to the low voltage source for providing the low voltage AC input signals comprising the steps of coupling the transformer AC common to the IRQ interrupt input port, executing a routine on each falling edge of the AC common voltage wave, the routine including the steps of reading the low voltage input signals at a time one quarter of a wave length after a respective falling edge of the AC common voltage wave, generating an output from the microprocessor to a selected relay to operate the relay and move the contacts into engagement a first delay time following the reading of the input signals based on a selected first fixed time constant, the selected first fixed time constant falling within a tolerance range derived for a group of relays from a maximum given first time constant of the group to a minimum given first time constant of the group and the first delay time being derived based on use of the maximum given first time constant as the selected first fixed time constant so that contact engagement for any relay within the group will generally occur prior to zero crossing of the AC line voltage.

12. A method for switching according to claim 11 in which the selected first fixed time constant is subtracted from the time of one half a wave length.

13. A method for switching according to claim 11 further including generating an output from the microprocessor to a selected relay to operate the relay and move the contacts into disengagement a second delay time following the reading of the input signals based on a selected second fixed time constant, the selected second fixed time constant falling within a tolerance range derived for a group of relays from a maximum second given time constant of the group to a minimum second given time constant of the group and the selected second fixed time constant being derived based on use of the maximum second given time constant so that contact disengagement for any relay within the group will generally occur prior to zero crossing of the AC line voltage.

14. A method for switching according to claim 11 in which a time period of one half a wave length is added to the first delay time on a random basis to vary the polarity of switching occasion on an ongoing basis.

15. A method for switching according to claim 15 when used with inductive loads further including generating an output from the microprocessor to a selected relay to operate the relay and move the contacts into disengagement based on the Real Time Clock, asynchronously to the AC line current.

16. A method for switching according to claim 14 in which a time period of one half of a wave length is added to the second delay time every other operation of the relay contacts into disengagement to vary the polarity every other contacts disengagement switching occasion.

17. A method for switching according to claim 14 in which a time period of one half a wave length is added to the second delay time on a random basis to vary the polarity of switching occasions on an ongoing basis.

18. A method for switching AC line current in a system including relays with relay contacts, a microprocessor for receiving low voltage AC input signals and providing output signals to operate the relay contacts to move into engagement and disengagement in response to the input signals, the relays having a first given time constant equal to the time used in the mechanical operation of moving the contacts into contact engagement and a second given time constant equal to the time used in the mechanical operation of moving the relay contacts into disengagement, the microprocessor having a Real Time Clock and an IRQ interrupt input port and transformer means for providing a low voltage source and having a transformer AC common and means coupled to the low voltage source for providing the low voltage AC input signals comprising the steps of coupling the transformer AC common to the IRQ interrupt input port, executing a routine on each falling edge of the AC common voltage wave, the routine including the steps of reading the low voltage input signals at a time one quarter of a wave length after a respective falling edge of the AC common voltage wave, generating an output from the microprocessor to a selected relay to operate the relay and move the contacts into engagement a first delay time following the reading of the input signals based on the first given time constant added to an additional delay time of one half AC line voltage wave length on a random basis, the additional delay time being derived from the Real Time Clock in order to change the polarity for contact engagement on a continuing basis.

* * * * *